US006814024B2

(12) United States Patent
Lazecki

(10) Patent No.: US 6,814,024 B2
(45) Date of Patent: Nov. 9, 2004

(54) METHOD AND DEVICE FOR THE VISUAL SIMULATION OF EXPLODING BODIES

(75) Inventor: René Lazecki, Kirchdorf (CH)

(73) Assignee: Ruag Electronics (CH)

( * ) Notice: Subject to any disclaimer, the term of this patent is extended or adjusted under 35 U.S.C. 154(b) by 0 days.

(21) Appl. No.: 10/359,491

(22) Filed: Feb. 5, 2003

(65) Prior Publication Data

US 2003/0150370 A1 Aug. 14, 2003

(30) Foreign Application Priority Data

Feb. 11, 2002 (CH) ..... 0219/02

(51) Int. Cl.[7] ..... F41H 9/06; G08B 5/40
(52) U.S. Cl. ..... 116/200; 116/214; 434/16
(58) Field of Search ..... 116/209, 200, 116/1, 211, 214, DIG. 1; 434/16, 21, 22, 23; 293/133, 136, 172, 71, 72, 73

(56) References Cited

U.S. PATENT DOCUMENTS

| | | | | |
|---|---|---|---|---|
| 2,408,429 A | | 10/1946 | Levey | |
| 3,407,827 A | * | 10/1968 | Follett | 137/39 |
| 4,764,660 A | * | 8/1988 | Swiatosz | 392/397 |
| 4,974,431 A | * | 12/1990 | Kyle | 68/5 C |
| 5,114,140 A | * | 5/1992 | Barr | 472/75 |
| 5,211,339 A | * | 5/1993 | Zeiler | 239/295 |
| 5,549,130 A | * | 8/1996 | Schuster | 137/39 |
| 5,803,359 A | | 9/1998 | Vandoninck | |
| 6,099,316 A | * | 8/2000 | Levy et al. | 434/16 |

FOREIGN PATENT DOCUMENTS

| | | | | |
|---|---|---|---|---|
| DE | 29621810 U1 | * | 4/1997 | F41H/9/06 |
| DE | EP 1 174 676 | | 1/2002 | |
| DE | 101 26 272 | | 12/2002 | |
| WO | WO 92/19344 | * | 11/1992 | A63J/5/02 |

OTHER PUBLICATIONS

European Search Report, Jun. 2003 (English translation attached).

* cited by examiner

*Primary Examiner*—Christopher W. Fulton
*Assistant Examiner*—R. Alexander Smith
(74) *Attorney, Agent, or Firm*—Ostrolenk, Faber, Gerb & Soffen, LLP

(57) ABSTRACT

The detonation of e.g. a grenade or another explosive body is simulated by the evaporation of a liquid and subsequent ejection through a nozzle 17, thereby forming a cloud of vapor at the location of the detonation. The device includes an evaporator 10 heated e.g. by combustion means. The heating system 14 is designed to produce the heat for a continuous evaporation of a liquid in the evaporator. The liquid is preferably a mixture of ethylene glycol in water. It is thereby possible to simplify the handling and application and to reduce the danger potential.

18 Claims, 3 Drawing Sheets

METHOD AND DEVICE FOR THE VISUAL SIMULATION OF EXPLODING BODIES

FIELD OF THE INVENTION

The present invention relates to a method for the visual simulation of exploding bodies. Furthermore, the invention relates to a device for carrying out the method.

BACKGROUND OF THE INVENTION

The simulation of combat activity in maneuvers also includes the simulated use of indirect fire weapons (artillery, mine throwers), amongst others. For the simulation, an array of signature bodies is previously laid out in the target area. Signature bodies are equipped with smoke generators that are capable of being selectively triggered, generally by radio. In order to simulate the effect of indirect fire weapons, a computer calculates the point of impact of the projectiles and triggers the corresponding smoke generators in the signature bodies in the field by radio, thereby allowing the trained troops to identify the danger and to react accordingly.

Furthermore, the trained troops possibly use their simulated weapons to fight vehicles, e.g. tanks. To inform the marksman, the vehicle crew, and all other participants of the fact that the vehicle has been hit, a signature mounted on the vehicle, e.g. in the form of smoke, is triggered. Smoke of different colors is often used to indicate different types of hits, e.g. a mine hit.

Different methods for generating such a signature or marking are known. One possibility is the combustion of pyrotechnics. In this case, a combustible substance is used that generates as dense smoke as possible. The ignition is generally effected by electric primers.

Another known method is the ejection of a fine inert powder. A very fine inert powder is filled into a cup on top of a pyrotechnic propelling charge. When the propelling charge is ignited, the powder is explosively expelled, thereby creating a visible cloud of powder. A further known method is the ignition of an explosive gas mixture mixed e.g. with atomized oil. To this end, an inflammable gas mixture, e.g. of butane/air, is produced in a controlled space. For producing smoke, the mixture is e.g. mixed with atomized oil. The mixture may be ignited by means of an electric spark. In the explosive combustion, the oil is burned as well, thereby producing visible smoke.

All the known methods have undesirable properties. Pyrotechnic methods and the combustion of oil generate more or less toxic products. Pyrotechnic methods cannot be influenced in the duration of the activity. Explosions generate loud noise. Combustions and explosions produce high temperatures. Therefore, such signature bodies require keeping a safe distance, which is hardly possible for the trained troops, especially when training at night. Toxicity is unacceptable particularly with regard to the trainees and also with regard to protection of the environment. Furthermore, the pyrotechnic representation is very expensive. Also, explosives or gases may only be handled by specially trained personnel.

SUMMARY OF THE INVENTION

It is an object of the present invention to provide a method for generating a signature that reduces the risk of the trainees. Another object is to generate a signature without the use of pyrotechnic means.

A method attaining at least the first object is defined in claim 1. The further claims indicate preferred embodiments as well as devices implementing the method.

Thus, the signature is generated by evaporation of a liquid, the sprayed vapor forming a clearly visible mist and thereby marking the (simulated) location of the explosion. The liquid (fluid) is preponderantly composed of water. The remaining components are preferably chosen such that the fluid is non-toxic.

The evaporating device essentially consists of a heat accumulator having a sufficiently high thermal capacity to provide, after being heated to a given operating temperature, the heat required for evaporating a sufficient amount of fluid for generating the signature of an explosion site. The heat accumulator may not cool below the temperature required for an evaporation. The heat accumulator is enclosed in a thermal insulation, so that a relatively small continuous heating power is required to maintain its operating temperature. The energy source used for heating is preferably a gas capable of being stored in a liquefied form, and the combustion for heat generation is further preferably effected in a flameless manner, e.g. in a catalytic burner.

BRIEF DESCRIPTION OF THE DRAWINGS

The invention will be explained by means of an exemplary embodiment with reference to figures.

DETAILED DESCRIPTION OF THE INVENTION

Figure 1:
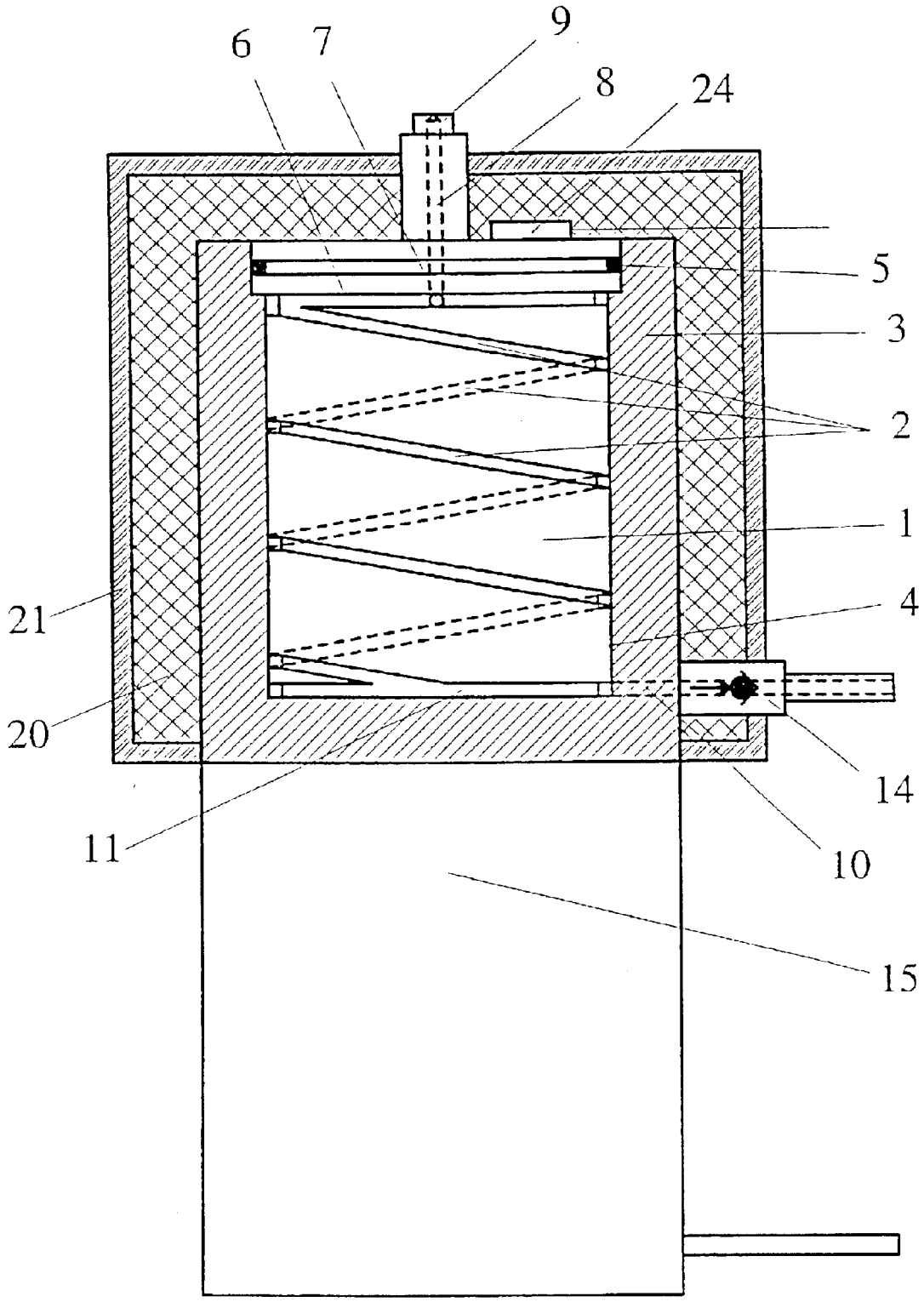
FIG. 1 schematically shows an evaporator in a cross-sectional view.
Figure 2:
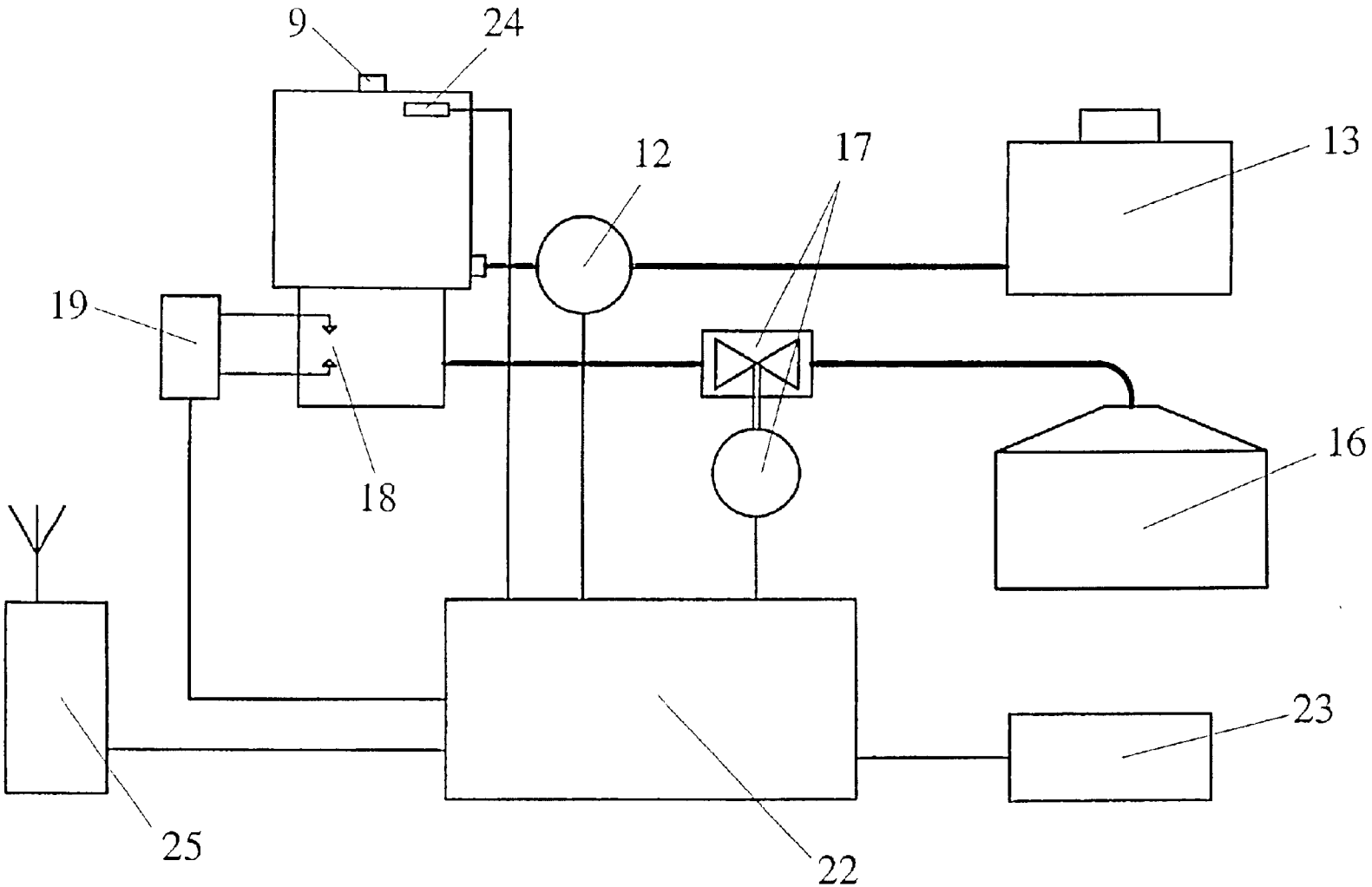
FIG. 2 shows a diagram of a possible arrangement.

Essentially, to produce the smoke, a liquid, preferably a mixture of water and glycol (fluid) is evaporated. This method is known and has been used for a long time in theaters, movies, and discotheques. The fluid as well as the generated vapor are non-toxic and safe to use even in closed rooms.

The quantity of vapor may be varied in a large range since in corresponding embodiments (continuous energy supply), the evaporation is controllable. In this case, the vapor quantity solely depends on the available quantity of fluid. The vapor height may be varied by varying the vapor pressure. Except for the hiss of the vapor and the noise of the pump, no noise is produced. At the outlet of the evaporator, the vapor is very hot (approx. 200° C.). However, since it is cooled very quickly in the air (few centimeters from the nozzle), thereby condensing and becoming visible, the safe distance from the nozzle is very short (only a few centimeters). If provided with an appropriate protecting device, a signature body of this kind may be operated without restrictions with regard to the safety distance.

In order to make the vapor visible also at night, it may be illuminated by lighting means incorporated in the signature body (flash lamp, LED, halogen radiator). In addition, if the signature body is to emit noise (explosion noise), this may be effected in a controlled manner over loudspeakers. Further advantages of this invention are: the fluid may be handled by anyone, and there are no restrictions with regard to the transport and the storage of the fluid. Also, the simulation of a shot only costs a tenth to a fiftieth of the known embodiments.

Known evaporators are built as follows: a storage container (mostly of plastics material) for the fluid; a pump for pumping the fluid into the evaporator; and the evaporator. As the evaporation of the liquid, which is mainly composed of pure water, requires very much energy and a device of this kind should be operational on the normally protected mains (Switzerland: 230 V/10 A), the required quantity of energy is first temporarily stored thermally in a massive metal body, the evaporator, that is mostly made of an aluminum alloy. To this end, heaters in the power range of typically 700 to 1500 W are incorporated in the evaporator. A temperature probe provided on the evaporator regulates the heaters such that heating is stopped at a temperature of typically 220° C. If the temperature falls below 180° C., the heaters are switched on again. Heating up typically takes between 3 and 12 minutes. Generally, these devices do not allow a continuous production of vapor as the supplied energy is insufficient for this purpose. Rather, vapor can only be produced for some 10 seconds before the stored energy is used up. In order to minimize heat losses through radiation, the known evaporator is generally thermally insulated by means of insulating materials. The interior of the evaporator is hollow. In order to enlarge the surface, the cavity is mostly spiral-shaped. The fluid pump is connected on one side of the evaporator and the steam nozzle on the other side. For the evaporation, the fluid is pumped into the hot evaporator. The fluid absorbs the heat of the evaporator and evaporates. The steam escapes through the steam nozzle under pressure.

For the application discussed in the introduction, i.e. the representation of signatures in the field, the usual embodiment including an electrically heated heat accumulator is not applicable since there are no mains connections in the field. Therefore, an operation is only possible with accumulators or batteries (the installation of electric lines is impossible since vehicles, especially tanks, circulate on the terrain. Even embedding of lines is impossible, besides the enormous costs, if tanks circulate on the terrain).

A heat accumulator supplied with energy by accumulators is not possible as the amount of energy required merely for maintaining the temperature for the desired duration of autonomy of seven days is much too large, even if the thermal insulation is very good. On the contrary, the heat accumulator must be heated by an energy source having a very high energy density. In the embodiment of the invention, butane, propane, or a mixture of butane and propane gas are used. Furthermore, the gas is burned in a catalytic process, i.e. in a flameless manner, thereby avoiding the inflammation of matter (leaves, grass) possibly deposited on the heat accumulator. The heat accumulator simultaneously constitutes the evaporator. Its mass is so dimensioned that when heated to its operating temperature of approx. 220° C., it may evaporate approx. 1 ml/s of the fluid during 5 s at the most, while cooling to approx. 200° C.

In the exemplary embodiment, the evaporator is composed of two parts. A spiral-shaped groove 2 is cut in the round insert 1, while a respective clearance 6, 11, whose width approximately corresponds to that of the groove, is cut out both at the beginning and at the end of the groove. Insert 1 is press-fitted into envelope 3, the dimensions being chosen such that the lands between the grooves of insert 1 seal with envelope 4, and especially such that the insert seals with the envelope on the nozzle side. To this end, a suitable sealing member, e.g. an O-ring 5, is inserted. On the nozzle side, clearance 6 of the spiral groove communicates with nozzle bore 8 through a transversal bore 7. The nozzle bore is provided with a screwed-in nozzle 9. At the opposite end of insert 1, a bore 10 (supply bore) is provided in the envelope at the height of clearance 11 of the spiral groove. Through this bore, the fluid from storage container 13 is pumped into the evaporator by means of a pump 12. When the evaporator is at its operating temperature, the fluid evaporates after a short delay and leaves the evaporator through the nozzle in the form of steam. In order to prevent that the steam may also move towards the pump, a commercially available nonreturn valve 14 is screwed into supply bore 10. As a heat source, a commercially available catalytic gas burner 15 is used whose operation is per se. The gas is supplied to the gas burner from a gas tank 16 by an electric valve 17. It is ignited by an electric spark generated by a small high voltage generator 19 in a discharge gap 18. In order to minimize the heat loss of the evaporator due to thermal radiation, the entire evaporator is covered, except on the burner side, with a thermally insulating material 20, e.g. rock wool. For its protection, the rock wool is covered with a casing 21 e.g. of stainless steel (stainless steel is a poor heat conductor). The entire arrangement is controlled by a microprocessor 22. In order to ensure immediate operation in use, microprocessor 22 regulates the temperature of the evaporator such that it is always in the range of approx. 200 to 220° C. To this end, it monitors the temperature of the evaporator by means of temperature probe 24 and closes electric gas valve 17. When required, it ignites the gas by means of high voltage generator 19 and discharge gap 18.

The required electric energy is supplied by an accumulator 23. When microprocessor 22 is triggered, e.g. by a connected radio module, to produce a vapor cloud, it will activate pump 12. The fluid passes from the storage container to the hot evaporator, where it evaporates at once and is ejected through steam nozzle 9.

In addition to the components that are essential for its operation, the device further comprises the usual precautions against inadmissible operating conditions such as a overpressure safety valve, overheat gas cutoff, safety against the penetration of liquid gas when the device is excessively tilted.

The application of the device may be as follows: First, the accumulators are charged and gas and fluid are filled in. Then the device is placed at the desired location in the field and switched on. The microprocessor verifies whether the different sensors (temperature, tilting angle) are in the admissible range. If this is the case, it opens the gas valve and ignites the gas. The success of the ignition is monitored by the corresponding sensor. By means of a 2-point regulation known per se, the temperature of the evaporator is always kept between approx. 200 and 220° C. When the microprocessor is instructed, e.g. by radio, to generate a vapor cloud, it activates the pump. In an overriding program section, all safety elements are continuously measured and action is immediately taken if necessary, generally by closing the gas valve and switching off the pump.

If the device is mounted on a vehicle, appropriate measures must be taken to ensure that no liquid gas may enter the burner.

Figure 3:
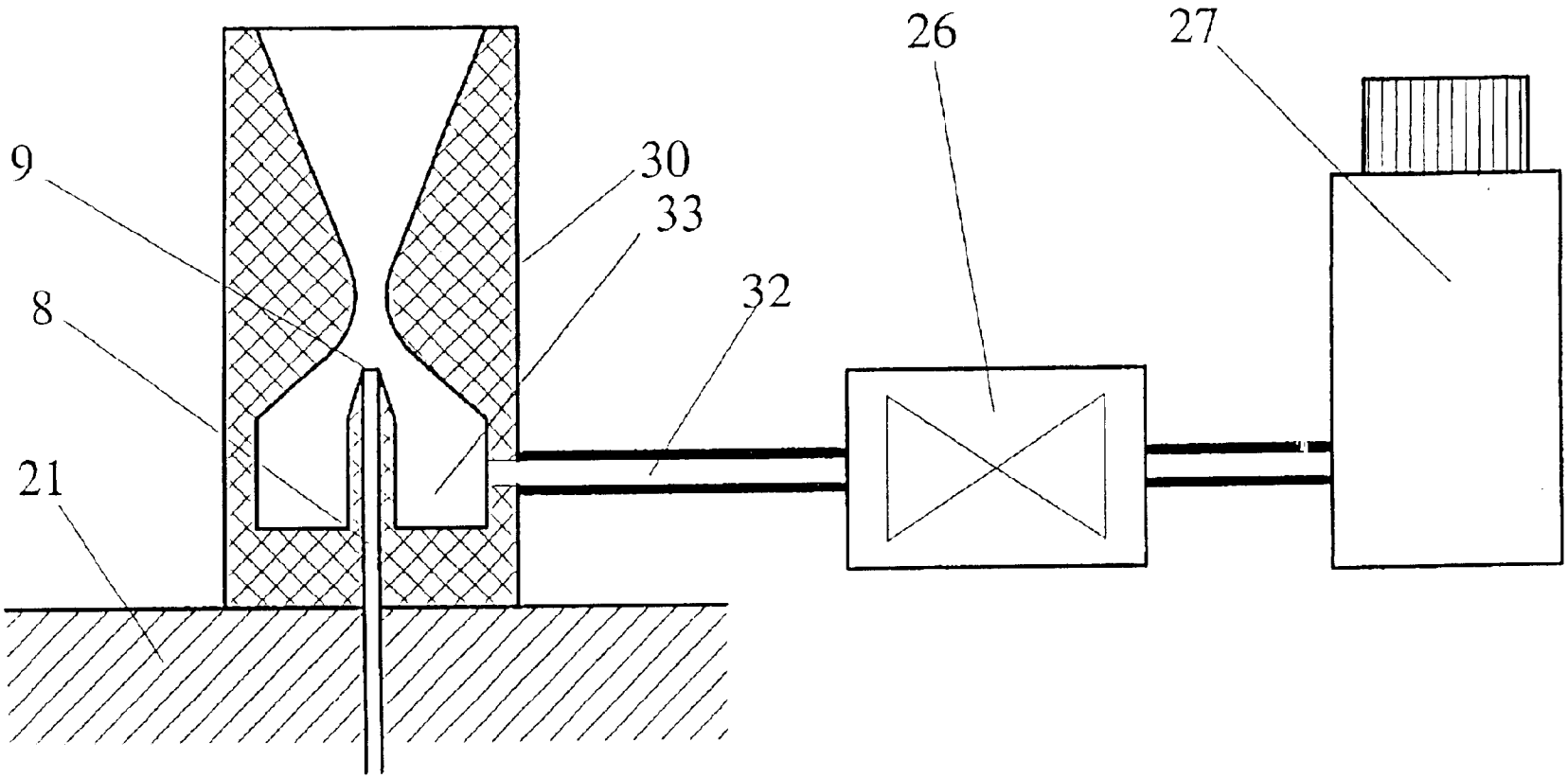
FIG. 3 shows a diagram of a steam jet injector for the coloration of the vapor.

In order to fulfill the requirement of colored vapor, a steam jet nozzle 30 (FIG. 3) may be used instead of the simple steam nozzle. The function and design of steam jet nozzles are commonly known. In this particular embodiment, the substance aspirated by the steam jet, which is contained in a storage container 27, is liquid foodstuff color. The strongly coloring foodstuff color thus colors the vapor. Since foodstuff color is non-toxic, the obtained colored vapor is non-toxic as well.

Storage container 27 is connected to the aspirating portion 33 of nozzle 30 by a duct 32. If duct 32 for the color is provided with e.g. an electrically operated valve 26, the coloration is controllable as desired, thus allowing to produce steam of different colors. If the three basic colors are used and selectively controllable valves 26 are provided, any color may be produced.

To those skilled in the art, numerous modifications are accessible from the preceding description of a preferred embodiment without leaving the scope of the invention as defined in the claims.

Thus, inter alia, it is possible to use an open gas flame (Bunsen burner) instead of the catalytic gas burner, to use the evaporator in place of the gas burner, or to use a combination of gas an electric energy.

Further possible modifications are:

Use of a different fuel or, more generally, of a different energy source, especially of a different gas or also of a liquid or solid fuel.

Particularly on vehicles, the initial heating may be effected by means of the energy source of high energy density, whereas the operational condition is maintained, i.e. heat losses are compensated by an electric heating connected to the electric system, more particularly that of the vehicle. Generally, a connection with the electric system is provided also because the vehicle is necessarily set out of operation when it has been hit.

It will be noted here that in military vehicles, a large number of accessories are often connected to the electric system which use energy also when the motor is stopped and thus discharge the battery of the vehicle. Therefore, it is advantageous here also to use a solution provided with an independent energy supply that is accessed at least at times when large amounts of energy are required. In the present simulating device, these are especially the initial heating and the reheating phases after an activation, during which the independent energy supply is used and the battery is saved.

For conditions of restricted visibility, particularly at night, an additional device for increasing the visibility may be provided, e.g. an illuminating device or a device for producing a light flash.

The continuous operational time may be chosen differently, particularly by an adaptation of the energy supply and/or the type of the energy source. It may be longer or also shorter, e.g. 3 days. A reasonable lower limit is thought to be one day.

What is claimed is:

1. A method for providing a visual simulation of exploding bodies, the method comprising:

storing heat in a heat accumulator, wherein the heat accumulator is associated with an evaporator;

placing a liquid in the evaporator, wherein the liquid comprises water;

bringing the liquid in the evaporator into thermal contact with the heat in the accumulator to produce a vapor, wherein a short delay occurs between the initiation of the visual simulation and the generation of the vapor, and wherein a cloud of vapor is then formed to provide the visual simulation of exploding bodies.

2. The method of claim 1, further comprising maintaining the heat accumulator at an operating temperature in order to have the temperature and the amount of heat required for the evaporation available by supplying heat to the heat accumulator, and wherein the accumulator is thermally insulated to reduce heat emissions to the environment.

3. The method of claim 1, wherein the liquid presents a minimal sanitary or environmental risk.

4. The method of claim 1, wherein the liquid further comprises ethylene glycol.

5. A device for providing a visual simulation of exploding bodies, the device comprising:

an evaporator to evaporate liquid;

a heat accumulator associated with the evaporator, the heat accumulator being capable of storing and delivering heat to evaporate a quantity of a liquid in the evaporator for providing a cloud vapor to provide the visual simulation of exploding bodies simulating at least one simulation event, wherein the heat accumulator is enclosed in an envelope of thermally insulating material to reduce the heating power required to evaporate the quantity of liquid; and a heating device thermally connected to the heat accumulator.

6. The device of claim 5, further comprising an energy source for operating the heating device to allow the heating device to be operational for at least one day.

7. The device of claim 5, further comprising a storage container storing gas in a liquefied form and connected to the heating device, wherein the heating device is operable to combust the gas.

8. The device of claim 5, wherein the heating device provides a flameless combustion of a fuel.

9. The device of claim 8, wherein the heating device provides combustion of the fuel by catalytic combustion.

10. The device of claim 5, wherein the evaporator includes the heat accumulator, the heat accumulator having a surface comprised of metal with a channel-shaped groove in the surface, and the channel-shaped groove is operable to evaporate liquid conducted through the groove.

11. The device of claim 5, wherein the evaporator has an outlet comprising a steam jet nozzle having an aspirating portion that is connected to at least one storage container for providing color.

12. The device of claim 5, further comprising:

a storage container for storing gas in a liquefied form;

a duct between the storage container and the heating device, the duct having a closure element;

a sensing means that determines an angle of tilt of the device and the direction in which gravity will act on the liquefied gas; and a control that is operatively connected to the sensing means, wherein the closure element of the duct is capable of being closed by the control to prevent liquefied gas from penetrating the heating device when the sensing means senses excessive tilting of the device.

13. The device of claim 5, further comprising a remotely activated and selectable control for triggering of the device to simulate an explosion.

14. The device of claim 13, further comprising:

a storage container for the liquid to be evaporated, a pump between the storage container and the evaporator for pumping the liquid, wherein the pump is adapted to be switched on and off by the control, thereby generating a simulation by switching on the pump when the device is activated.

15. The device of claim 13, further comprising a device for activating the control by radio.

16. The device of claim 5, further comprising a device to provide acoustic or optical signals in order to improve the perceptibility of the simulation.

17. The device of claim 5, further comprising an energy source for operating the heating device to allow the heating device to be operational for at least three days.

18. The device of claim 15, further comprising an energy source for operating the heating device to allow the heating device to be operational for at least seven days.

* * * * *

UNITED STATES PATENT AND TRADEMARK OFFICE

CERTIFICATE OF CORRECTION

PATENT NO. : 6,814,024 B2
DATED : November 9, 2004
INVENTOR(S) : René Lazecki

It is certified that error appears in the above-identified patent and that said Letters Patent is hereby corrected as shown below:

Column 5,
Line 62, after "wherein the" insert -- heat --.

Column 6,
Line 7, after "cloud" insert -- of --.
Line 63, replace "claim 15" with -- claim 5 --.

Signed and Sealed this

Twenty-second Day of February, 2005

JON W. DUDAS
*Director of the United States Patent and Trademark Office*